US010052012B2

(12) United States Patent
Mesa et al.

(10) Patent No.: US 10,052,012 B2
(45) Date of Patent: Aug. 21, 2018

(54) HOLDING ASSEMBLY

(71) Applicant: ELECTROLUX APPLIANCES AKTIEBOLAG, Stockholm (SE)

(72) Inventors: Daniel Mesa, Stockholm (SE); Rickard Hederstierna, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/323,054

(22) PCT Filed: Sep. 1, 2014

(86) PCT No.: PCT/EP2014/068527
§ 371 (c)(1),
(2) Date: Dec. 29, 2016

(87) PCT Pub. No.: WO2016/034200
PCT Pub. Date: Mar. 10, 2016

(65) Prior Publication Data
US 2017/0135553 A1 May 18, 2017

(51) Int. Cl.
*A47B 77/08* (2006.01)
*A47L 15/50* (2006.01)

(52) U.S. Cl.
CPC ..... *A47L 15/505* (2013.01); *A47L 15/50* (2013.01)

(58) Field of Classification Search
CPC ..... A47L 15/50; A47L 15/501; A47L 15/502; A47L 15/505
USPC ..... 211/41.8, 41.9
See application file for complete search history.

(56) References Cited

U.S. PATENT DOCUMENTS

| | | | |
|---|---|---|---|
| 2,213,918 | A | 9/1940 | Lofstrand, Jr. |
| 2,708,037 | A | 5/1955 | Planeta |
| 3,512,227 | A | 5/1970 | Krawagna |
| 3,627,300 | A | 12/1971 | Caveney |
| 3,752,322 | A | 8/1973 | Fiocca et al. |
| 4,029,277 | A | 6/1977 | Bulanda |

(Continued)

FOREIGN PATENT DOCUMENTS

| | | | |
|---|---|---|---|
| CN | 201061516 | Y | 5/2008 |
| CN | 101977539 | A | 2/2011 |

(Continued)

OTHER PUBLICATIONS

International Search Report and Written Opinion for Application No. PCT/EP2012/076769 dated Feb. 11, 2013.

(Continued)

*Primary Examiner* — Matthew W Ing
(74) *Attorney, Agent, or Firm* — Alston & Bird LLP

(57) ABSTRACT

A holding assembly for holding one or more stemmed objects in a dishwasher is provided. The holding assembly may include a main frame, and a gripping unit frame arranged on the main frame. The gripping unit frame may include one or more gripping units where each gripping unit is arranged to grip a respective stemmed portion of one of the one or more stemmed objects. The holding assembly may include a first support frame foldably arranged on the main frame to allow the first support frame to be folded between at least a supporting position and a storing position. The first support frame may be arranged to support a portion of the one or more stemmed objects in the supporting position. The embodiments herein may also relate to a rack of a dishwasher and a dishwasher comprising a rack.

24 Claims, 5 Drawing Sheets

(56) References Cited

U.S. PATENT DOCUMENTS

| | | | |
|---|---|---|---|
| 4,046,261 | A | 9/1977 | Yake |
| 4,589,556 | A | 5/1986 | Peretz |
| 4,909,401 | A | 3/1990 | McConnell |
| 4,974,806 | A | 12/1990 | Matern |
| 5,119,947 | A | 6/1992 | Stewart |
| 5,249,590 | A | 10/1993 | Jacobus et al. |
| D342,005 | S | 12/1993 | Forsberg |
| 5,277,387 | A | 11/1994 | Lewis et al. |
| 5,572,776 | A | 11/1996 | Murphy et al. |
| 5,918,749 | A | 7/1999 | Pille et al. |
| 6,123,204 | A | 9/2000 | Nelson et al. |
| 6,364,131 | B1 | 4/2002 | Moylan |
| 6,394,285 | B1 | 5/2002 | Arthurs et al. |
| 6,827,225 | B2 | 12/2004 | Miilu et al. |
| 6,932,312 | B1 | 8/2005 | Chen |
| 7,231,929 | B2 | 6/2007 | Landsiedel et al. |
| D547,048 | S | 7/2007 | Conway et al. |
| 7,458,471 | B2 | 12/2008 | Crudgington, Jr. |
| 7,523,902 | B2 | 4/2009 | Almeida |
| 7,543,712 | B2 | 6/2009 | Purushothaman |
| 7,556,231 | B2 | 7/2009 | Herbst et al. |
| 7,665,475 | B2 | 2/2010 | Hedstrom et al. |
| 7,766,175 | B2 | 8/2010 | Jadhav et al. |
| D642,039 | S | 7/2011 | Forsberg et al. |
| 7,988,107 | B2 | 8/2011 | Miller et al. |
| 8,167,147 | B2 | 5/2012 | Frankel et al. |
| 8,573,576 | B2 | 11/2013 | Clark et al. |
| 8,701,898 | B2 | 4/2014 | Chai |
| 8,757,419 | B2 | 6/2014 | Schessl et al. |
| 8,789,711 | B2 | 7/2014 | Haltmayer et al. |
| 9,615,722 | B2 | 4/2017 | Mesa et al. |
| 2004/0108283 | A1 | 6/2004 | Miilu et al. |
| 2005/0236344 | A1 | 10/2005 | Yang et al. |
| 2005/0236345 | A1 | 10/2005 | Herbst et al. |
| 2006/0113260 | A1 | 6/2006 | Purushothaman et al. |
| 2006/0138064 | A1 | 6/2006 | Crudgington |
| 2006/0254992 | A1 | 11/2006 | Lim |
| 2006/0289038 | A1 | 12/2006 | Hedstrom et al. |
| 2007/0125729 | A1 | 6/2007 | Krueger |
| 2007/0163626 | A1 | 7/2007 | Klein |
| 2008/0110480 | A1 | 5/2008 | Choi et al. |
| 2008/0135505 | A1 | 6/2008 | Frankel et al. |
| 2008/0149149 | A1 | 6/2008 | Ryu et al. |
| 2008/0185352 | A1 | 8/2008 | O'Hara |
| 2011/0192808 | A1 | 8/2011 | Buhl et al. |
| 2011/0247990 | A1 | 10/2011 | Chai |
| 2011/0290804 | A1 | 12/2011 | Kohles et al. |
| 2012/0292273 | A1 | 11/2012 | McNamara |
| 2014/0021149 | A1 | 1/2014 | Eng et al. |
| 2016/0037997 | A1 | 2/2016 | Mesa et al. |
| 2017/0254472 | A1 | 9/2017 | Foresberg |

FOREIGN PATENT DOCUMENTS

| | | | |
|---|---|---|---|
| DE | 30 22 484 | A1 | 1/1982 |
| DE | 92 16 330 | U1 | 4/1994 |
| DE | 94 07 327 | U1 | 7/1994 |
| DE | 94 21 847 | U1 | 11/1996 |
| DE | 297 11 822 | U1 | 10/1998 |
| DE | 297 20 069 | U1 | 3/1999 |
| DE | 299 02 157 | U1 | 5/1999 |
| DE | 298 22 086 | U1 | 6/1999 |
| DE | 200 05 725 | U1 | 8/2000 |
| EP | 1 356 761 | A2 | 10/2003 |
| EP | 1 424 035 | A1 | 6/2004 |
| EP | 1 683 465 | A1 | 7/2006 |
| EP | 1 925 251 | A2 | 5/2008 |
| EP | 1 929 928 | A1 | 6/2008 |
| EP | 2 245 975 | A1 | 11/2010 |
| EP | 2 353 488 | A1 | 8/2011 |
| EP | 2 554 099 | A2 | 2/2013 |
| EP | 2 554 101 | A1 | 2/2013 |
| EP | 2 777 475 | A1 | 9/2014 |
| FR | 2152375 | A1 | 4/1973 |
| GB | 1393054 | A | 5/1975 |
| GB | 2321394 | A | 7/1989 |
| WO | WO 2005/042212 | A1 | 5/2005 |
| WO | WO 2007/057135 | A1 | 5/2007 |
| WO | WO 2009/097139 | A1 | 8/2009 |
| WO | WO 2013/045543 | A1 | 4/2013 |
| WO | WO 2013/098009 | A1 | 7/2013 |
| WO | WO 2014/094898 | A1 | 6/2014 |
| WO | WO 2014/108079 | A1 | 7/2014 |

OTHER PUBLICATIONS

Office Action for U.S. Appl. No. 14/654,980 dated Jul. 1, 2016.
Notice of Allowance for U.S. Appl. No. 14/654,980 dated Dec. 6, 2016.
Office Action for Chinese Application No. 201280078146.7 dated Oct. 10, 2016.
International Search Report and Written Opinion for Application No. PCT/EP2014/068527 dated Nov. 26, 2014.
International Search Report and Written Opinion for Application No. PCT/EP2014/068528 dated May 11, 2015.
International Search Report and Written Opinion for Application No. PCT/EP2014/068529 dated May 7, 2015.
Office Action for U.S. Appl. No. 15/323,066 dated Oct. 4, 2017, 14 pages.
Office Action for U.S. Appl. No. 15/323,066 dated May 10, 2018, 9 pages.

HOLDING ASSEMBLY

CROSS-REFERENCE TO RELATED APPLICATIONS

This application is a national stage application filed under 35 U.S.C. § 371 of International Application No. PCT/EP2014/068527 filed Sep. 1, 2014, which application is hereby incorporated by reference in its entirety.

TECHNICAL FIELD

Embodiments herein relate to accessories for dishwashers. In particular, the embodiments herein relate to a holding assembly for holding one or more stemmed objects in a dishwasher. The embodiments herein also relates to a rack of a dishwasher and a dishwasher comprising a rack.

BACKGROUND

Loading and emptying a dishwasher are time consuming activities, which may put strain on a user's back. Also, manual dishwashing by hand is time consuming and many users also consider such activities to be burdensome.

Further, interior environments of today's dishwashers are not always adapted to receive delicate items, such as wine glasses, champagne glasses etc. The interior of a dishwasher is usually designed to receive plates. Moreover, it is typically desired that the interior is robust such that it can receive heavy and bulky cookware, such as pots and pans. Therefore, problems may arise when delicate items such as wine glasses, champagne glasses etc., are loaded into such an interior.

The document U.S. Pat. No. 4,589,556 A relates to a holder assembly designed to removably mount one or more long stemmed articles such as stemmed glassware on a conventional dish supporting rack of a dishwasher in a manner such that the stemmed article will not be inadvertently dislodged from the holder assembly during force applied thereto by jets of water during the cleaning operation. The holding assembly described in the document does not eliminate the above mentioned problems.

In view of above, there is a need for an improved holding assembly which may overcome some of the above mentioned problems.

SUMMARY

An object of the embodiments herein is to provide an improved holding assembly.

According to an aspect of the embodiments herein, the object is achieved by a holding assembly for holding one or more stemmed objects in a dishwasher, the holding assembly comprising a main frame, and a gripping unit frame arranged on the main frame, the gripping unit frame comprising one or more gripping units where each gripping unit of the one or more gripping units is arranged to grip a respective stemmed portion of one of the one or more stemmed objects, wherein the holding assembly further comprises a first support frame foldably arranged on the main frame to allow the first support frame to be folded between at least a supporting position and a storing position, where the first support frame is arranged to support a portion of the one or more stemmed objects in the supporting position. Since the holding assembly comprises a first support frame foldably arranged on the main frame to allow the first support frame to be folded between at least a supporting position and a storing position, supporting of stemmed objects may be achieved simply by folding the first support frame to the supporting position. Also, storing of the holding assembly is facilitated by folding the first support frame to the storing position. Hence, the holding assembly may be stored in a space efficient manner while in the storing position and yet it may be folded out to the supporting position when a user needs support for the one or more stemmed objects, such as glasses.

Further, a user may remove the holding assembly, from a dishwasher, together with a number of stemmed objects since stemmed portions of such stemmed objects may be gripped by the gripping units and since portions of such stemmed objects may be supported by the first support frame. The user may therefore bring a number of stemmed objects, such as glasses, with him/her when a dishwashing cycle is finished and the glasses are to be stored in a kitchen cabinet or similar. Thus, the user is allowed to empty the dishwasher in a fast and secure manner which also may reduce strain on the user's back.

Accordingly, an improved holding assembly is provided. As a result, the above mentioned object is achieved.

Optionally, the holding assembly further comprises a second support frame foldably arranged on the main frame to allow the second support frame to be folded between at least a further supporting position and a further storing position, where the second support frame is arranged to support a portion of the one or more stemmed objects in the supporting position. Since the holding assembly further comprises a second support frame foldably arranged on the main frame to allow the second support frame to be folded between at least a further supporting position and a further storing position, a holding assembly is provided where the one or more stemmed objects can be supported by two support frames. Also, since the second support frame is foldably arranged on the main frame to allow the second support frame to be folded between at least a further supporting position and a further storing position, storing of the holding assembly may be facilitated. Also, a first and a second support frame may provide for an even more efficient and secure emptying process of stemmed objects from a dishwasher.

Optionally, the first support frame is arranged on a first side of the main frame and the second support frame is arranged on a second side of the main frame where the first side is opposite to the second side with respect to the main frame. That is, the first side may be oppositely located, or positioned to, the second side with respect to the main frame. Since the first support frame is arranged on a first side of the main frame and the second support frame is arranged on a second side of the main frame, the one or more stemmed objects, may be supported on both the first and second side of the main frame. Also, since both the first support frame and the second support frame may be foldably arranged on the main frame to allow respective first support frame and second support frame to be folded, a user may choose to use one or both of the first side and the second side of the main frame for holding stemmed objects in a dishwasher. As a result, a flexible holding assembly is provided which may facilitate loading of stemmed objects into a dishwasher. Also, a holding assembly is provided which may facilitate an efficient use of a space within a dishwasher and which may adapt to different loads of stemmed objects.

Optionally, the gripping unit frame comprises a first portion, comprising the one or more gripping units, and a second portion comprising one or more further gripping units, and where the first portion is arranged to protrude from the first side of the main frame and where the second portion is arranged to protrude from the second side of the main frame, at least when the gripping unit frame is in a gripping position. Due to these features, an improved holding assembly is provided since portions of the gripping unit frame will protrude from both the first and the second side of the main frame allowing gripping of stemmed portions on both the first and the second side of the main frame, at least when the gripping unit frame is in a gripping position.

Optionally, the gripping unit frame is pivotably arranged on the main frame to allow the gripping unit frame to be pivoted between at least a storing position and a gripping position. In the storing position, the gripping unit frame may be aligned, or essentially aligned, with the main frame. In this manner, the holding assembly may be formed into a flat shape. Thereby, storage of the holding assembly may be facilitated.

Optionally, an angle between the gripping unit frame and the main frame is approximately 90 degrees when the gripping unit frame is in the gripping position and the angle between the gripping unit frame and the main frame is approximately 0 degrees when the gripping unit frame is in the storing position. Storage of holding assembly is facilitated due to the angle between the gripping unit frame and the main frame being approximately 0 degrees when the gripping unit frame is in the storing position. Also, since an angle between the gripping unit frame and the main frame is approximately 90 degrees when the gripping unit frame is in the gripping position, an extension of stemmed objects being gripped by gripping units at the gripping unit frame may substantially coincide with the main frame. As a result, a compact holding assembly may be provided even when stemmed objects are held by the holding assembly.

Optionally, each gripping unit is displaceably arranged at the gripping unit frame. Thereby, a position of each gripping unit may be adjusted to allow a flexible positioning of stemmed objects in the holding assembly. Also, a distance between two or more gripping units of each gripping units may be adjusted. As a result, the holding assembly is adapted to hold stemmed objects with different diameters. Stemmed objects with different diameters may be champagne glasses and wine glasses. Further, a space within a dishwasher in which the holding assembly is positioned may be utilized more efficiently.

Optionally, the holding assembly further comprises a gripping unit frame snap device arranged to hold the gripping unit frame in the storing position. Since the holding assembly further comprises a gripping unit frame snap device arranged to hold the gripping unit frame in the storing position, storing of the holding assembly may be facilitated.

Optionally, an angle between the first support frame and the main frame is approximately 90 degrees when the first support frame is in the supporting position and where the angle between the first support frame and the main frame is approximately 0 degrees when the first support frame is in the storing position. Storage of holding assembly is facilitated due to the angle between the first support frame and the main frame being approximately 0 degrees when the first support frame is in the storing position. Also, due to the angle between the first support frame and the main frame being approximately 90 degrees when the first support frame is in the supporting position, supporting of portions of stemmed objects may be further improved.

Optionally, the holding assembly further comprises at least a first support frame snap device arranged to hold at least the first support frame in the storing position. Since the holding assembly further comprises at least a first support frame snap device arranged to hold at least the first support frame in the storing position, storage of the holding assembly may be facilitated.

Optionally, each gripping unit has a gripping mode and a releasing mode where each gripping unit is arranged to release the respective stemmed portion in the releasing mode, and where each gripping unit is arranged to grip the respective stemmed portion in the gripping mode. Since each gripping unit has a gripping mode and a releasing mode, holding of one or more stemmed objects may be ensured and removal of the one or more stemmed objects from a dishwasher may be facilitated.

Optionally, each gripping unit comprises a first arm and a second arm and a flexible strip arranged between the first and second arms. Since each gripping unit comprises a first arm and a second arm and a flexible strip arranged between the first and second arms, gripping of the one or more stemmed objects may be further improved.

Optionally, the flexible strip is arranged to at least partially enclose the stemmed portion when each gripping unit is in the gripping mode. Since the flexible strip is arranged to at least partially enclose the stemmed portion when each gripping unit is in the gripping mode, gripping of the one or more stemmed objects may be improved. This is advantageous, not only for holding stemmed objects in a dishwasher during a washing cycle, but also when the holding assembly are removed from the dishwasher together with a number of stemmed objects. A user can therefore, in a safe and secure manner, bring a number of stemmed objects with him/her when a dish washing cycle is finished and the stemmed objects are to be stored in a kitchen cabinet or similar.

Optionally, the first arm and the second arm are rotably arranged at the holding assembly and where each gripping unit is arranged such that a tip of the first arm and a tip of the second arm are arranged to be closer to each other when each gripping unit is in the gripping mode than when the gripping unit is in the releasing mode. Thereby, gripping of a stemmed portion of a stemmed object may be further improved.

Optionally, the gripping unit frame has a horizontal extension, where each gripping unit is arranged at an angle to the horizontal extension of the gripping unit frame, where the angle is in the range of 10-30 degrees, preferably in the range of 15-25 degrees, and more preferably approximately 20 degrees. Thereby, washing and drying of a stemmed object, being held in a dishwasher by the holding assembly, may be improved since water more easily may reach portions of such a stemmed object and water may run off such a stemmed object in a more efficient manner. In particular, drying of stemmed objects, such as wine glasses and champagne flutes, may be improved since water may run off from a bowl-shaped foot portion of such a glass, due to each gripping unit being arranged at an angle to the horizontal extension of the gripping unit frame.

Optionally, the main frame of the holding assembly further comprises a handle portion and the holding assembly is arranged to be positioned in, and removed from, a rack of a dishwasher. Since the main frame of the holding assembly further comprises a handle portion, carrying of the holding assembly is facilitated. Also, since the holding assembly is arranged to be positioned in, and removed from, a rack of a dishwasher, a user may load stemmed objects, such as glasses in the holding assembly and then, positioning the holding assembly in a rack of a dishwasher. As a result, the holding assembly facilitates the activity of loading stemmed objects, such as glasses, into a dishwasher. Also, since the holding assembly comprises one or more frames being foldable, the holding assembly can be stored in an easy manner for example adjacent to cookery books in a kitchen, or in a rack of a dishwasher.

According to a second aspect of the embodiments herein, the object is achieved by a rack of a dishwasher comprising a holding assembly according to some embodiments.

According to a third aspect of the embodiments herein, the object is achieved by a dishwasher comprising a rack according to some embodiments.

Further features of, and advantages with, the embodiments herein will become apparent when studying the appended claims and the following detailed description. Those skilled in the art will realize that the different features described may be combined to create embodiments other than those described in the following, without departing from the scope of the embodiments herein, as defined by the appended claims.

BRIEF DESCRIPTION OF THE DRAWINGS

The various aspects of the embodiments herein, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined. Like numbers refer to like elements throughout.

Well-known functions or constructions will not necessarily be described in detail for brevity and/or clarity.

Figure 1:
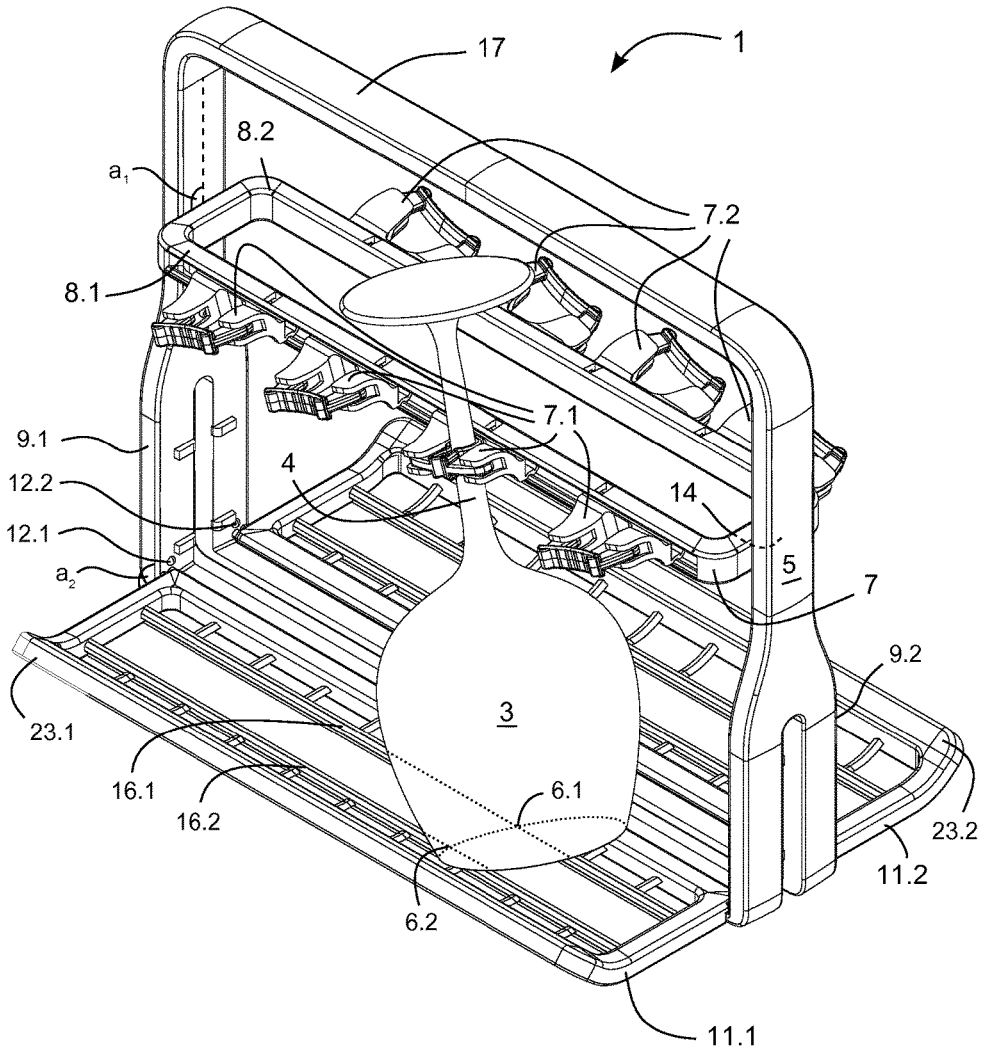
FIG. 1 illustrates a holding assembly with a first support frame in a supporting position and with a second support frame in a further supporting position and with the gripping unit frame in a gripping position.

FIG. 1 illustrates an exemplifying holding assembly 1 for holding one or more stemmed objects 3 in a dishwasher. The holding assembly 1 comprises a main frame 5, and a gripping unit frame 7 arranged on the main frame 5. The gripping unit frame 7 comprises one or more gripping units 7.1, 7.2 where each gripping unit 7.1, 7.2 of the one or more gripping units 7.1, 7.2 is arranged to grip a respective stemmed portion 4 of one of the one or more stemmed objects 3. The holding assembly 1 further comprises a first support frame 11.1 foldably arranged on the main frame 5 to allow the first support frame 11.1 to be folded between at least a supporting position and a storing position. The first support frame 11.1 is arranged to support a portion 6.1, 6.2 of the one or more stemmed objects 3 in the supporting position. In FIG. 1, the first support frame 11.1 is illustrated in the supporting position.

The holding assembly 1 further comprises a second support frame 11.2 foldably arranged on the main frame 5 to allow the second support frame 11.2 to be folded between at least a further supporting position and a further storing position. In FIG. 1, the second support frame 11.2 is illustrated in the further supporting position. The second support frame 11.2 is arranged to support a portion of the one or more stemmed objects 3 in the further supporting position.

The first support frame 11.1 is arranged on a first side 9.1 of the main frame 5 and the second support frame 11.2 is arranged on a second side 9.2 of the main frame 5 where the first side 9.1 is opposite to the second side 9.2 with respect to the main frame 5.

The gripping unit frame 7 comprises a first portion 8.1, comprising one or more gripping units 7.1, and a second portion 8.2 comprising one or more further gripping units 7.2. The first portion 8.1 is arranged to protrude from the first side 9.1 of the main frame 5 and the second portion 8.2 is arranged to protrude from the second side 9.2 of the main frame 5, at least when the gripping unit frame 7 is in a gripping position. Thereby, stemmed objects 3, such as wine glasses, can be held on both the first and second sides 9.1, 9.2 of the main frame 5.

The gripping unit frame 7 is pivotably arranged on the main frame 5 to allow the gripping unit frame 7 to be pivoted between at least a storing position and a gripping position. In FIG. 1, the gripping unit frame 7 is illustrated in the gripping position.

Accordingly, the holding assembly 1, illustrated in FIG. 1, is illustrated with the first support frame 11.1 in the supporting position and with the second support frame 11.2 in the further supporting position and with the gripping unit frame 7 in the gripping position.

As illustrated in FIG. 1, an angle $a_1$ between the gripping unit frame 7 and the main frame 5 is approximately 90 degrees when the gripping unit frame 7 is in the gripping position.

Also, an angle $a_2$ between the first support frame 11.1 and the main frame 5 is approximately 90 degrees when the first support frame 11.1 is in the supporting position. Likewise, the angle between the second support frame 11.2 and the main frame 5 is approximately 90 degrees when the second support frame 11.2 is in the further supporting position.

Figure 2:
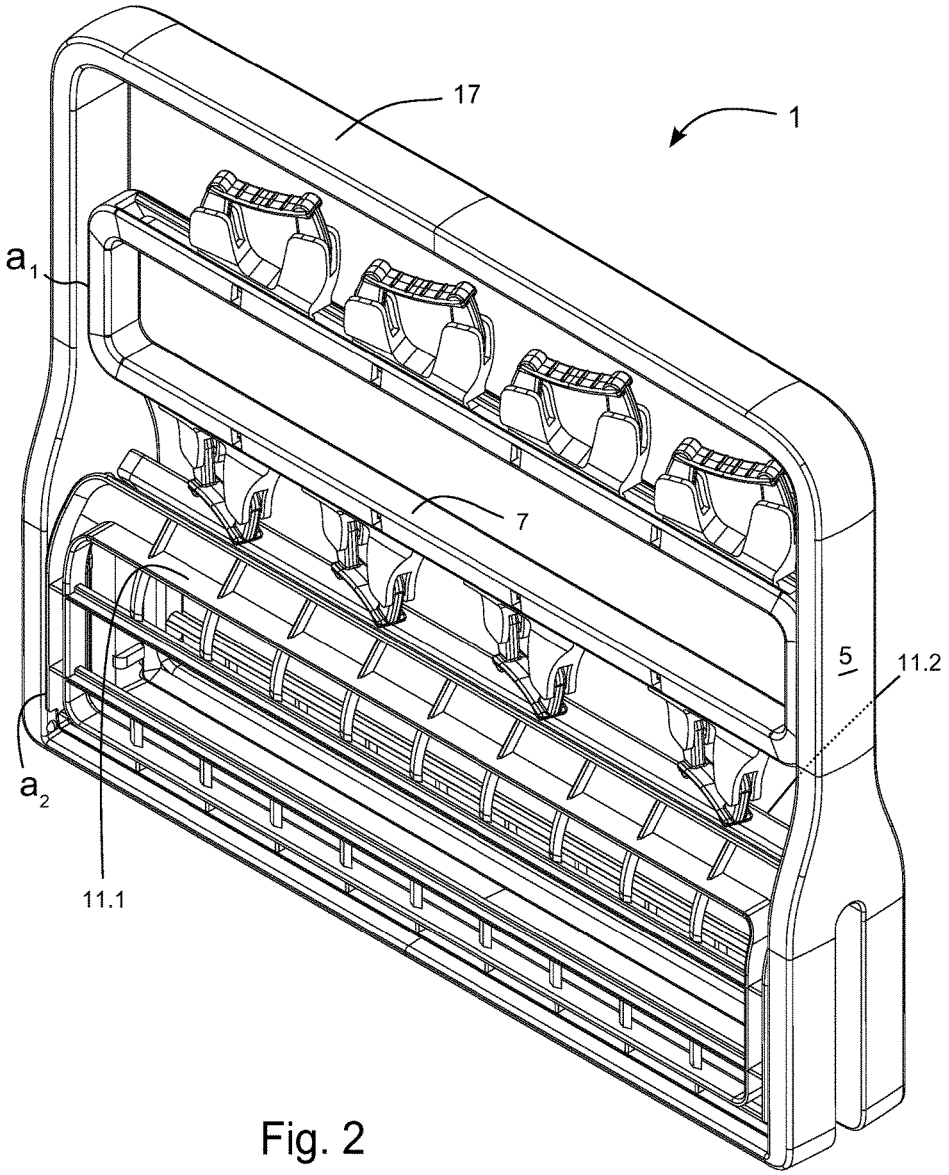
FIG. 2 illustrates the holding assembly 1 illustrated in FIG. 1 with the first support frame in a storing position and with the second support frame in a further storing position and with the gripping unit frame in a storing position.

FIG. 2 illustrates the holding assembly 1 illustrated in FIG. 1 with the first support frame 11.1 in the storing position and with the second support frame 11.2 in the further storing position and with the gripping unit frame 7 in the storing position.

As illustrated in FIG. 2, the angle $a_1$ between the gripping unit frame 7 and the main frame 5 is approximately 0 degrees when the gripping unit frame 7 is in the storing position.

Also, the angle $a_2$ between the first support frame 11.1 and the main frame 5 is approximately 0 degrees when the first support frame 11.1 is in the storing position. Likewise, the angle between the second support frame 11.2 and the main frame 5 is approximately 0 degrees when the second support frame 11.2 is in the storing position.

Since these angles are approximately 0 degrees when respective frame 7, 11.1, 11.2 are in respective storing position, storing of the holding assembly 1 is facilitated since the holding assembly 1 becomes essentially flat when respective frame 7, 11.1, 11.2 are in respective storing position. Thereby, the holding assembly 1 can be stored in a drawer or a shelf, or the like, for example adjacent to cookery books, without occupying much space.

As illustrated in FIG. 1, each gripping unit 7.1, 7.2 is displaceably arranged at the gripping unit frame 7. Thereby, a position of each gripping unit 7.1, 7.2 may be adjusted to allow a flexible positioning of stemmed objects 3 in the holding assembly 1. Also, a distance between two or more gripping units 7.1, 7.2 of each gripping units 7.1, 7.2 may be adjusted. As a result, a holding assembly 1 is provided where stemmed objects 3, such as glasses, having different diameters can be held. Further, a space within the holding assembly 1, and thus also a dishwasher in which the holding assembly 1 is positioned, may be utilized more efficiently since stemmed objects 3 may be positioned with a small distance between the stemmed objects 3.

The holding assembly 1 further comprises a gripping unit frame snap device 14 arranged to hold the gripping unit frame 7 in the storing position. The snap device 14 may comprise a protrusion arranged at the main frame 5 and a recess arranged on the gripping unit frame 7 which protrusion is arranged to extend into the recess when the gripping unit frame 7 is in the storing position so as to hold the gripping unit frame 7 in the storing position. Of course, the protrusion may be arranged at the gripping unit frame 7 and the corresponding recess may be arranged on the main frame 5.

Also, the gripping unit frame 7 may be slidably arranged to the main frame so as to allow an adjustment of a distance between the gripping unit frame 7 and the first support frame 11.1 and/or the second support frame 11.2. Thereby, a flexible holding arrangement 1 is provided since the distance between the gripping unit frame 7 and the first support frame 11.1 and/or the second support frame 11.2 may be adjusted. Thereby, supporting of stemmed objects, having different heights, may be achieved by adjusting the distance such that stemmed objects, being gripped by gripping units 7.1, 7.2 of the gripping unit frame 7, are supported by the first support frame 11.1 and/or the second support frame 11.2. Such stemmed objects, having different heights, may for example be wine glasses, champagne flutes and brandy/cognac cups.

The holding assembly 1 may comprise a first support frame snap device 12.1 arranged to hold the first support frame 11.1 in the storing position. The holding assembly 1 may further comprise a second support frame snap device 12.1 arranged to hold the second support frame 11.2 in the storing position. The first and/or the second support frame snap devices 12.1, 12.2 may comprise one or more protrusions and recesses arranged to hold first and/or the second support frames 11.1, 11.2 in the respective storing position.

Figure 3:
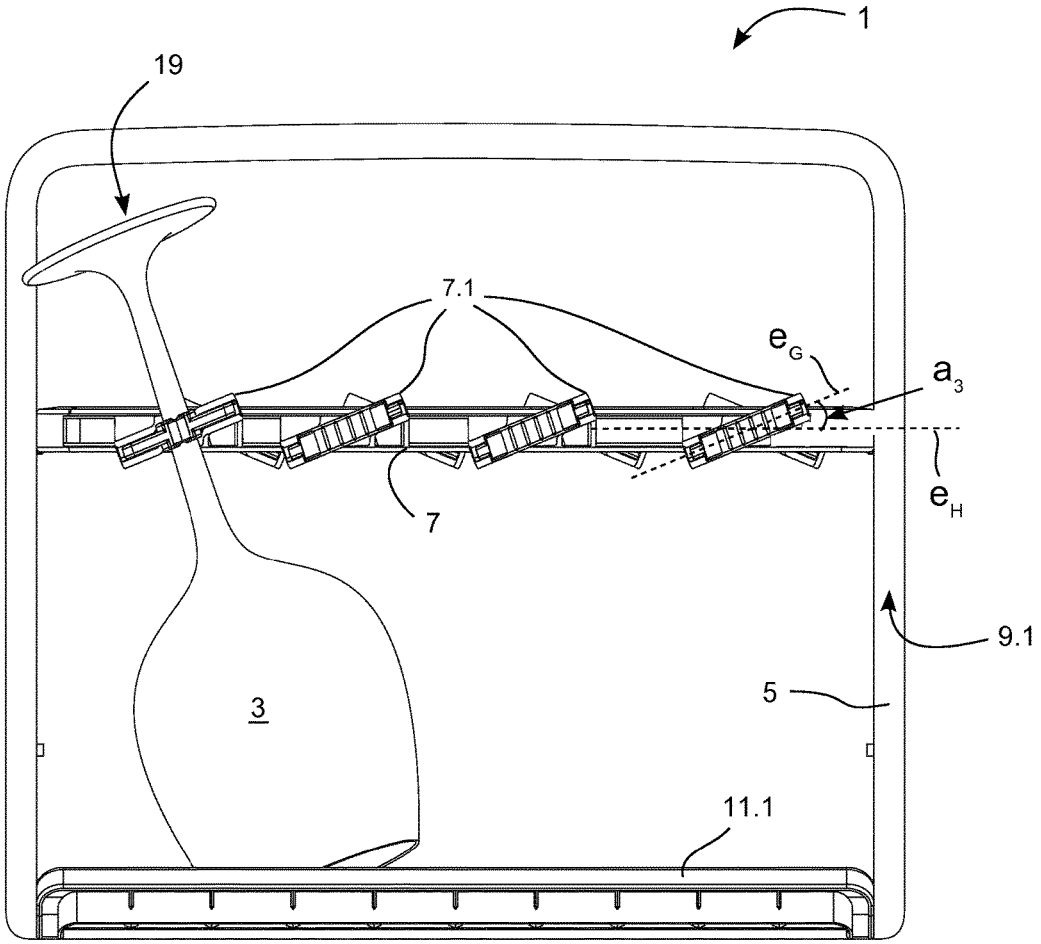
FIG. 3 illustrates the holding assembly illustrated in FIG. 1 and FIG. 2 viewed straight towards a first side of the holding assembly.

FIG. 3 illustrates the holding assembly 1 illustrated in FIG. 1 and FIG. 2 viewed straight towards the first side 9.1. In FIG. 3, the gripping unit frame 7, the first support frame 11.1 and the second support frame (not shown) are in respective storing position. As illustrated in FIG. 3, the gripping unit frame 5 has a horizontal extension $e_H$, where each gripping unit 7.1 are arranged such that a gripping extension $e_G$ is arranged at an angle $a_3$ to the horizontal extension $e_H$ of the gripping unit frame 5, where the angle $a_3$ is in the range of 10-30 degrees, preferably in the range of 15-25 degrees, and more preferably approximately 20 degrees. The angle $a_3$ illustrated in FIG. 1 is approximately 20 degrees. The gripping extension $e_G$ essentially coincides with a plane essentially perpendicular to a main extension of a stemmed portion of a stemmed object being gripped by a gripping unit 7.1.

Thereby, washing and drying performance of stemmed objects 3, being held in a dishwasher by the holding assembly 1, may be improved since water more easily may reach portions of such a stemmed object 3 and water may run off such a stemmed object 3 in a more efficient manner. In particular, drying of stemmed objects 3 such as wine glasses and champagne flutes may be improved since water may run off from a bowl-shaped foot portion 19 of such a glass, due to each gripping unit 7.1 being arranged at an angle $a_3$ to the horizontal extension $e_H$ of the gripping unit frame 7.

Furthermore, holding of stemmed objects in the holding assembly 1 may be improved due to each gripping unit 7.1, 7.2 being arranged at an angle $a_3$ to the horizontal extension $e_H$ of the gripping unit frame 5, which will be explained in the following. As illustrated in FIG. 1, the first support frame 11.1 may comprise a first elongated support rail 16.1 and a second elongated support rail 16.2. Thereby, in embodiments where each gripping unit 7.1, 7.2 is arranged at an angle $a_3$ to the horizontal extension $e_H$ of the gripping unit frame 5, the first support frame 11.1 supports two portions 6.1, 6.2 of the one or more stemmed objects 3 in the supporting position. That is, the first elongated support rail 16.1 of the first support frame 11.1 abuts a first portion 6.1 of the stemmed object 3 and the second elongated support rail 16.2 of the first support frame 11.1 abuts a second portion 6.2 of the stemmed object 3. These support portions 6.1, 6.2 are illustrated in FIG. 1 as the point of intersections between the edge of the stemmed object 3 and the respective elongated support rail 16.1, 16.2, which each are illustrated by dotted lines in FIG. 1. The first and second elongated support rails 16.1, 16.2 may be provided in a soft material to provide a soft support surface for stemmed objects. The soft material may be a ThermoPlastic Elastomers (TPE). Such soft material may be moulded over Polypropylene (PP). In such embodiments, the ThermoPlastic Elastomers (TPE) may provide softness and the PolyPropylene (PP) may provide structure and rigidity.

Similarly, the second support frame 11.2 may comprise corresponding first and second elongated support rails, corresponding to the first and second elongated support rails 16.1, 16.2 of the first support frame 11.1.

Accordingly, due to each gripping unit 7.1 being arranged at an angle $a_3$ to the horizontal extension $e_H$ of the gripping unit frame and the arrangement with respective elongated support rail 16.1, 16.2, a stemmed object, such as a wine glass, will be supported at three points. Thereby, the holding assembly 1 gives good support to stemmed objects 3 being held in the assembly. Thereby, the likelihood of a stemmed object 3 falling out of the holding assembly 1 is further reduced.

Further, as illustrated in FIG. 1, the first support frame 11.1 and/or the second support frame 11.2 may comprise a respective angled portion 23.1, 23.2 extending from a main extension plane of respective support frame 11.1, 11.2. Such angled portions 23.1, 23.2 may further ensure that stemmed objects 3, being held in the holding assembly, do not fall of, or tilts in a direction away from, the holding assembly 1.

Each gripping unit 7.1, 7.2 has a gripping mode and a releasing mode, where each gripping unit 7.1, 7.2 is arranged to release the respective stemmed portion 4 in the releasing mode, and where each gripping unit 7.1, 7.2 is arranged to grip the respective stemmed portion 4 in the gripping mode.

Figure 4:
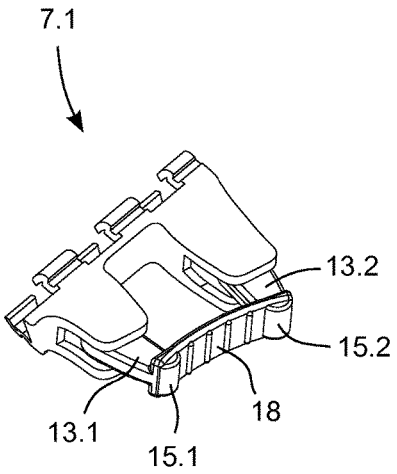
FIG. 4 illustrates a gripping unit in a releasing mode.

FIG. 4 illustrates a gripping unit 7.1 in a releasing mode. The gripping unit 7.1 comprises a first arm 13.1 and a second arm 13.2 and a flexible strip 18 arranged between the first and second arms 13.1, 13.2. The first arm 13.1 and the second arm 13.2 are rotably arranged with respect to the gripping unit frame 7 of the holding assembly.

Figure 5:
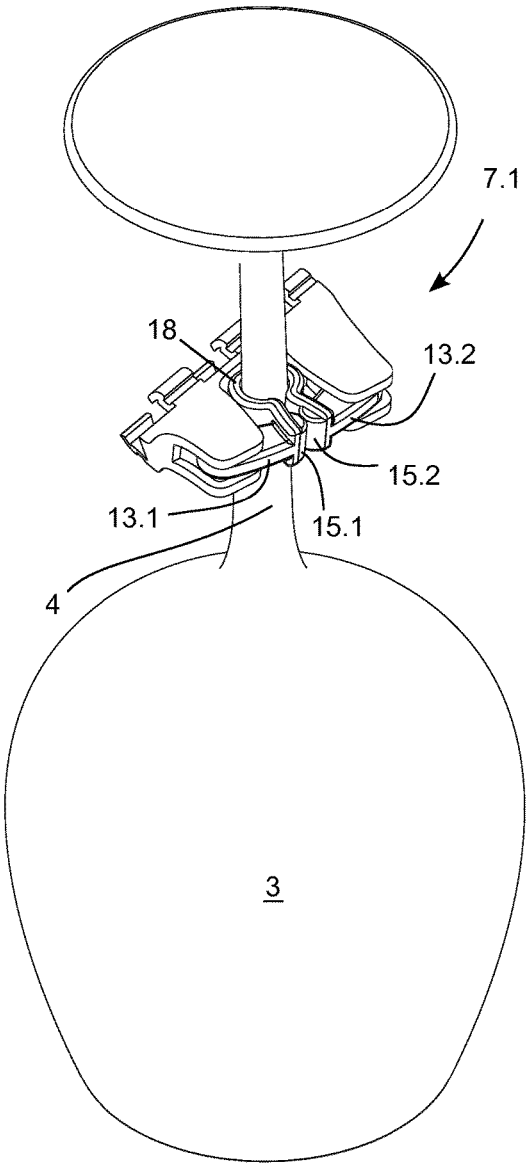
FIG. 5 illustrates the gripping unit illustrated in FIG. 4 in a gripping mode.

FIG. 5 illustrates the gripping unit illustrated in FIG. 4 in a gripping mode. As illustrated in FIG. 5, the flexible strip 18 is arranged to at least partially enclose a stemmed portion 4 of a stemmed object 3, when the gripping unit 7.1, 7.2 is in the gripping mode.

Also, as can be seen in FIG. 4 and FIG. 5, a tip 15.1 of the first arm 13.1 and a tip 15.2 of the second arm 13.2 are arranged to be closer to each other when the gripping unit 7.1 is in the gripping mode than when the gripping unit is in the releasing mode.

The flexible strip 18 and/or the first arm 13.1 and the second arm 13.2 may be provided in a soft material. Such soft material may be a ThermoPlastic Elastomers (TPE).

Due to these features, gripping of a stemmed portion 4 of a stemmed object 3 may be secured, even in cases where a user tilts the holding assembly 1 to different angels or handles the holding assembly roughly in some way.

Figure 6:
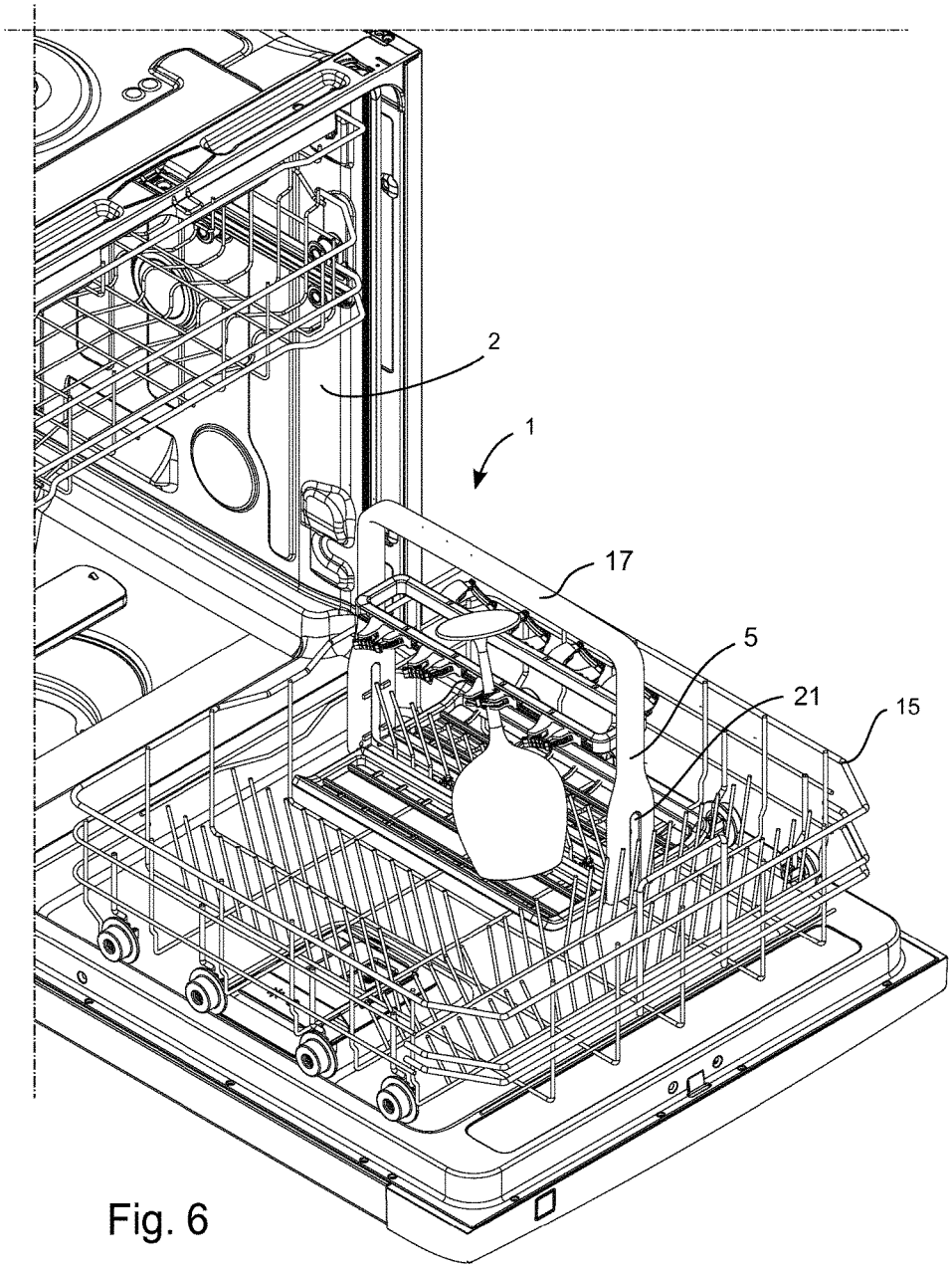
FIG. 6 illustrates a holding assembly positioned in a rack of a dishwasher.

FIG. 6 illustrates a holding assembly 1 positioned in a rack 15 of a dishwasher 2. As illustrated, the holding assembly 1 is positioned in a lower rack 15 of a dishwasher 2. The holding assembly 1 may be provided with features facilitating positioning of the holding assembly 1 in a lower rack 15 of a dishwasher 2. Such features may be a handle portion 17 facilitating positioning, and removal, of the holding assembly 1 to and from the rack 15 of a dishwasher 2. Thus, the handle portion 17 may receive e.g. a hand of a user when the holding assembly 1 is positioned in, and removed from, the rack 15 of the dishwasher 2. Further, such feature may be a size of the holding assembly 1 which enables positioning of the holding assembly 1 in the rack 15. Also, such feature may be that the main frame 5 of the holding assembly 1 is provided with a recess 21 arranged to receive tines of the rack 15 when the holding assembly 1 is positioned in the rack 15. Thereby, positioning of the holding assembly 1 in a lower rack 15 of a dishwasher 2 is facilitated and tines of the rack 15 extending into the recess 21 may provide support for the holding assembly 1.

In FIG. 6, both the first and the second support frames are in respective supporting position. Thereby, stemmed objects, such as wine glasses, can be held on both sides of the holding assembly 1. However, since both first and the second support frames are foldably arranged between a respective supporting position and a respective storing position, a user may choose to fold one of the first and the second support frames to the storing position and only use one side of the holding assembly to hold stemmed objects. Thereby, space can be provided to other items to be washed inside the dishwasher when only few stemmed objects are to be washed. Further, a user can fold both the first and the second support frames to the respective storing position and position the holding assembly 1 to the side of the rack 15 when the holding assembly 1 is not used to hold stemmed objects.

It is to be understood that the foregoing is illustrative of various example embodiments and the embodiments herein is not to be limited to the specific embodiments disclosed and that modifications to the disclosed embodiments, combinations of features of disclosed embodiments as well as other embodiments are intended to be included within the scope of the appended claims.

The invention claimed is:

1. A holding assembly for holding one or more stemmed objects in a dishwasher, said holding assembly comprising:
   a main frame, and
   a gripping unit frame arranged on said main frame, said gripping unit frame comprising one or more gripping units where each gripping unit of said one or more gripping units is arranged to grip a respective stemmed portion of one of said one or more stemmed objects, wherein said holding assembly further comprises:
   a first support frame foldably arranged on said main frame to allow said first support frame to be folded between at least a supporting position and a storing position, where said first support frame is arranged to support a portion of said one or more stemmed objects in said supporting position,
   wherein said holding assembly is arranged to be positioned in, and removed from, a rack of a dishwasher.

2. The holding assembly according to claim 1, where said holding assembly further comprises a second support frame foldably arranged on said main frame to allow said second support frame to be folded between at least a further supporting position and a further storing position, where said second support frame is arranged to support a portion of said one or more stemmed objects in said supporting position.

3. The holding assembly according to claim 2, where said first support frame is arranged on a first side of said main frame and said second support frame is arranged on a second side of said main frame where said first side is opposite to said second side with respect to said main frame.

4. The holding assembly according to claim 3, where said gripping unit frame comprises a first portion, comprising said one or more gripping units, and a second portion comprising one or more further gripping units, and where said first portion is arranged to protrude from said first side of said main frame and where said second portion is arranged to protrude from said second side of said main frame, at least when said gripping unit frame is in a gripping position.

5. The holding assembly according to claim 1, where said gripping unit frame is pivotably arranged on said main frame to allow said gripping unit frame to be pivoted between at least a storing position and a gripping position.

6. The holding assembly according to claim 5, where an angle ($a_1$) between said gripping unit frame and said main frame is approximately 90 degrees when said gripping unit frame is in said gripping position and where said angle ($a_1$) between said gripping unit frame and said main frame is approximately 0 degrees when said gripping unit frame is in said storing position.

7. The holding assembly according to claim 1, where each gripping unit is displaceably arranged at said gripping unit frame.

8. The holding assembly according to claim 1, further comprising a gripping unit frame snap device arranged to hold said gripping unit frame in said storing position.

9. The holding assembly according to claim 1, where an angle ($a_2$) between said first support frame and said main frame is approximately 90 degrees when said first support frame is in said supporting position and where said angle ($a_2$) between said first support frame and said main frame is approximately 0 degrees when said first support frame is in said storing position.

10. The holding assembly according to claim 1, further comprising at least a first support frame snap device arranged to hold at least said first support frame in said storing position.

11. The holding assembly according to claim 1, where each gripping unit has a gripping mode and a releasing mode, where said each gripping unit is arranged to release said respective stemmed portion in said releasing mode, and where said each gripping unit is arranged to grip said respective stemmed portion in said gripping mode.

12. The holding assembly according to claim 11, where said each gripping unit comprises a first arm and a second arm and a flexible strip arranged between said first and second arms.

13. The holding assembly according to claim 12, where said flexible strip is arranged to at least partially enclose said stemmed portion when said each gripping unit is in said gripping mode.

14. The holding assembly according to claim 12, where said first arm and said second arm are rotably arranged at said holding assembly, and where said each gripping unit is arranged such that a tip of said first arm and a tip of said second arm are arranged to be closer to each other when said each gripping unit is in said gripping mode than when said gripping unit is in said releasing mode.

15. The holding assembly according to claim 1, where said gripping unit frame has a horizontal extension, where each gripping unit is arranged at an angle ($a_3$) to said horizontal extension (ex) of said gripping unit frame, where said angle ($a_3$) is in the range of 10-30 degrees.

16. The holding assembly according to claim 1, where said main frame of said holding assembly further comprises a handle portion.

17. A rack of a dishwasher comprising a holding assembly according to claim 1.

18. A dishwasher comprising a rack according to claim 17.

19. A holding assembly for holding one or more stemmed objects in a dishwasher, said holding assembly comprising:

a main frame, a gripping unit frame arranged on said main frame, said gripping unit frame comprising one or more gripping units where each gripping unit of said one or more gripping units is arranged to grip a respective stemmed portion of one of said one or more stemmed objects, wherein said gripping unit frame is pivotably arranged on said main frame to allow said gripping unit frame to be pivoted between at least a storing position and a gripping position, and a first support frame foldably arranged on said main frame to allow said first support frame to be folded between at least a supporting position and a storing position, where said first support frame is arranged to support a portion of said one or more stemmed objects in said supporting position.

20. The holding assembly according to claim 19, where each gripping unit has a gripping mode and a releasing mode, where said each gripping unit is arranged to release said respective stemmed portion in said releasing mode, and where said each gripping unit is arranged to grip said respective stemmed portion in said gripping mode.

21. The holding assembly according to claim 20, where said each gripping unit comprises a first arm and a second arm and a flexible strip arranged between said first and second arms.

22. The holding assembly according to claim 21, where said flexible strip is arranged to at least partially enclose said stemmed portion when said each gripping unit is in said gripping mode.

23. The holding assembly according to claim 21, where said first arm and said second arm are rotably arranged at said holding assembly, and where said each gripping unit is arranged such that a tip of said first arm and a tip of said second arm are arranged to be closer to each other when said each gripping unit is in said gripping mode than when said gripping unit is in said releasing mode.

24. The holding assembly according to claim 19, where said gripping unit frame has a horizontal extension, where each gripping unit is arranged at an angle ($a_3$) to said horizontal extension ($e_H$) of said gripping unit frame, where said angle ($a_3$) is in the range of 10-30 degrees.

* * * * *